United States Patent [19]

Brush

[11] 4,363,255

[45] Dec. 14, 1982

[54] PIANO ACTION MAGNETIC TAPE RECORDING PROCESS AND APPARATUS FOR PLAYER PIANO PLAYBACK

[75] Inventor: Gary T. Brush, Sault Ste. Marie, Ontario, Canada, P6A 4J9

[73] Assignee: Sounds Alive Systems, Inc., Houghton Lake, Mich.

[21] Appl. No.: 147,489

[22] Filed: May 7, 1980

[51] Int. Cl.[3] ..... G10F 1/00

[52] U.S. Cl. ..... 84/1.03; 84/115; 84/1.28; 84/462; 84/DIG. 29; 360/4; 360/79

[58] Field of Search ..... 84/1.03, 1.28, 115, 84/462, 1.02, DIG. 29; 360/4, 43, 79

[56] References Cited

U.S. PATENT DOCUMENTS 3,876,863 4/1975 Boone ..... 360/4

OTHER PUBLICATIONS

Tremaine, Audio Cyclopedia, 1979, pp. 263, 758, 759.

*Primary Examiner*—J. V. Truhe
*Assistant Examiner*—Forester W. Isen

[57] ABSTRACT

A process and apparatus are provided for recording electric signals corresponding to piano key operation and for reproducing the piano key operation. The process includes switching a discrete frequency oscillator corresponding to each piano key, algebraically adding the outputs of each oscillator, filtering the algebraic sum of the oscillator outputs through a low pass filter, recording the filtered signal, reproducing said filtered signal through a high pass filter, detecting each frequency in the high pass filtered signal, and energizing an electromechanical device so as to actuate the piano key which had switched the discrete frequency oscillator. The apparatus in the record mode includes an oscillator responsive to each piano key operation for generating a sine wave of a predetermined frequency for each key, a voltage divider circuit for algebraically adding the oscillator signals, a low pass filter for filtering the combined signal to generate a signal in which the energy levels of each of the component signals are equal, and a recorder for preserving the filtered signal. The apparatus in the playback mode includes a high pass filter for reproducing the algebraic sum signal from the recorded signal, a detection stage for detecting the presence of each discrete frequency signal in the algebraic sum signal, and electromagnetic apparatus for manipulating the keys in response to each frequency detected.

11 Claims, 2 Drawing Figures

PIANO ACTION MAGNETIC TAPE RECORDING PROCESS AND APPARATUS FOR PLAYER PIANO PLAYBACK

BACKGROUND OF THE INVENTION

Player pianos have been in common usage for many years. While player pianos differ in their general configuration, they usually function in substantially the same manner.

A typical player piano has a keyboard containing 88 keys similar to the keys of most other pianos. Above the keyboard of most player pianos is a mechanism which provides for the automatic operation of the piano. This mechanism in most player pianos employs a tracker bar in which is situated an array of pneumatic holes. Each hole corresponds to a single key of the keyboard.

The typical player piano control apparatus also includes two spindles which cooperate to hold the ends of a scroll so the center of the scroll is stretched tightly across the tracker bar. The scroll, which is often called a tape, is usually made of paper.

The typical player piano utilizes a source of power and interior mechanical parts which wind the scroll from one spindle to the other across the tracker bar at a predetermined speed and which also include a pneumatic system that applies suction to each tracker bar hole on the side opposite the paper scroll. The pneumatic system detects a pressure differential in the tracker bar holes to operate the piano keyboard action in a predetermined manner.

The player piano action is controlled by putting openings of predetermined size and length in the paper scroll so the openings cross the tracker bar holes in a predetermined manner.

When a paper scroll hole is aligned with a tracker bar hole, the corresponding pneumatic system detects normal atmospheric pressure in the tracker bar hole. When a solid portion of the paper scroll covers a tracker bar hole, it prevents the passage of air through the tracker bar hole and the pneumatic mechanism therefore senses a different air pressure in the tracker bar hole than the level of air pressure existing therein when a hole in the paper scroll permits ambient air pressure surrounding the piano to communicate with the tracker bar hole.

The aforedescribed paper scroll and player piano mechanics in operation are attractive in a nostalgic sense, but have certain inherent disadvantages. For example, the paper scroll can easily be torn or damaged. The paper scroll is also relatively bulky. The scroll drive mechanism requires maintenance, and the paper roll may tear. Paper is also subject to distortion and warping from humidity changes and moisture content in the atmosphere. In addition, the whole paper drive process of winding the paper roll across a tracker bar involves a delivery apparatus especially vulnerable to mechanical failure from breakage and wear of parts, which generally include electric motor or vacuum drives, speed control governors, braking mechanisms, and tracking devices controlling paper alignment.

It is therefore an object of this invention to provide a process for reproducing key action of a piano by generating AC signals which are unique to the operation of each key, but unrelated to the musical instrument function performed by such key, recording such signals, reproducing such signals, and operating the keys corresponding to such signals.

It is a further object of this invention to provide a process of generating unique electric signals corresponding to key operation using only AC signals and in which the total energy responsive to each key operation is magnetically recorded at the same level to facilitate recording maximum data in a given recording medium.

It is a further object of this invention to provide apparatus for generating a recorded signal responsive to key operation by generating a recorded signal having combined components that are each of a discrete frequency and of equal energy levels in response to each key operation.

It is a further object of this invention to provide apparatus for reproducing key operation responsive to a recorded signal that includes multiple frequencies of equal energy by detecting each such recorded signal and operating a discrete unit in response to each frequency signal.

For purposes of describing the subject process, it should be noted that the term "key" may include any type apparatus having two discrete conditions. While the term "key" is primarily directed to those applications in which the key is one of a standard set of keys in a player piano, it will be apparent to persons versed in the art that for purposes of the subject process, a key may also be a key on an organ or a corresponding actuation mechanism on a different musical instrument and may also be a control unit on an instrument such as the sustain pedal on a piano or a stop on an organ which enhances particular sounds emanating from the organ. A key may also be an electric switch.

SUMMARY OF THE INVENTION

This invention is of a unique process and apparatus for reproducing key action of a piano or other musical instrument having a set of keys or the equivalent which are manually operable to produce a desired noise or other signal. As each of said keys are switched from a first position to a second position, a predetermined AC signal is generated by an oscillator. Each of the AC signals are algebraically added and their combined sum is filtered through a low pass filter so as to generate a filtered signal in which the energy level attributed to each AC signal is the same and the filtered signal is recorded in magnetic tape. On playback, the recorded signal is filtered through a high pass filter and each of the AC signals is detected and used to energize an electromechanical device that operates each of the keys to reproduce the original key action or otherwise actuates the device as originally operated.

DESCRIPTION OF THE PREFERRED EMBODIMENT

All of the components to be used in the subject invention are standard units which are conveniently available to persons versed in the art and are used in numerous applications. Persons versed in the art will recognize immediately the various components and realize that various other components could be substituted so long as they have similar functions while still accomplishing the same result as the subject invention, thus without departing from the spirit of the invention, which will be best understood by reference to the accompanying description and drawing, in which.

Figure 1:
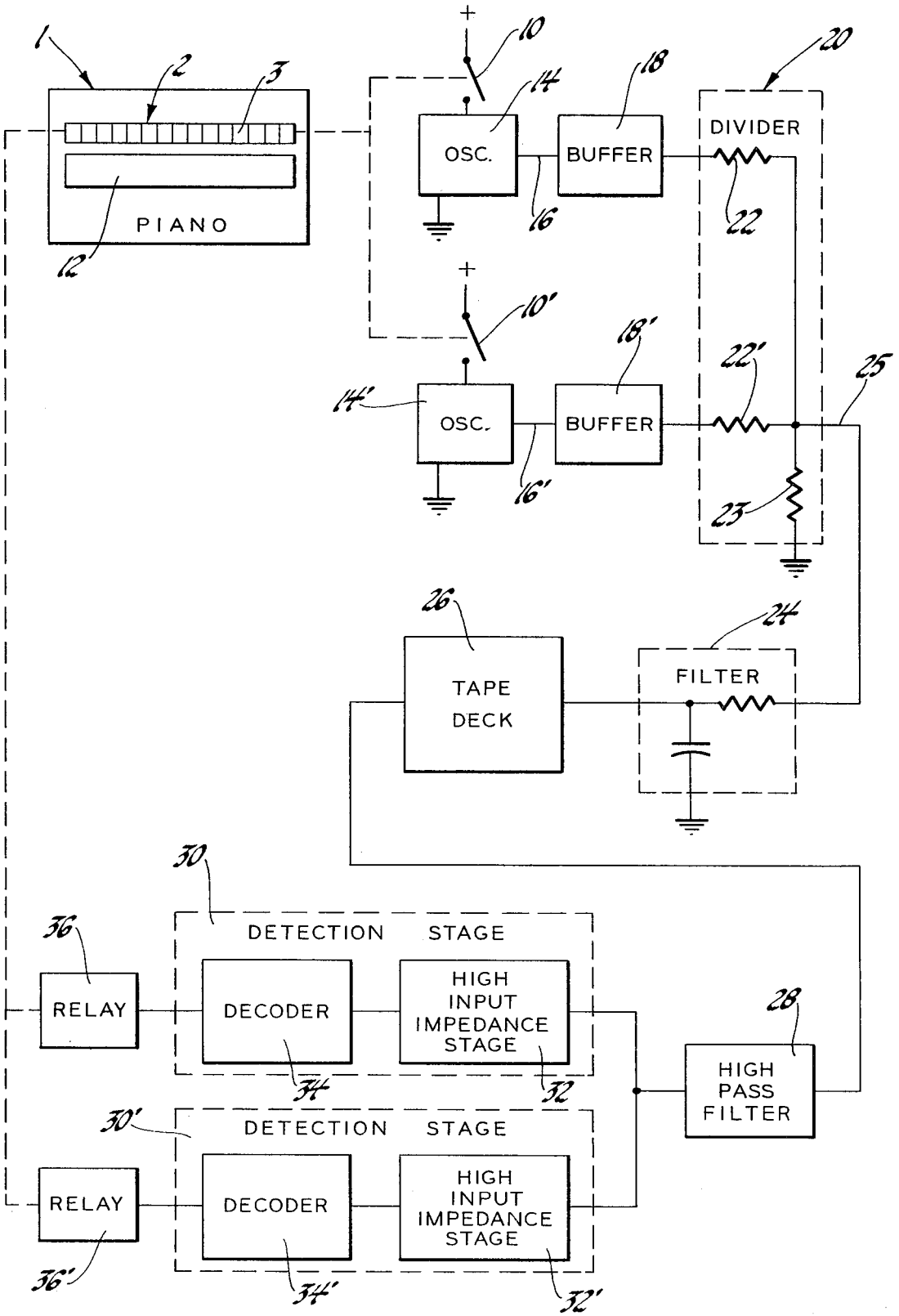
FIG. 1 is a schematic block diagram of apparatus which may be utilized to practice the subject process.

To record electric signals which correspond to unique operational sequence of a set of keys on a musical instrument according to the subject invention, the first step is generating a discrete frequency AC signal as each of the keys of a musical instrument is switched from a first position to a second position. As persons versed in the art will appreciate, the subject process could easily be applied to a piano, an organ, or various other musical instruments having numerous keys. For purposes of describing the process, it will be assumed that the process applies to the instrument commonly known as a piano 1 having a keyboard 2 as illustrated in FIG. 1. It has non-musical applications also.

Each piano key 3 in keyboard 2 of the piano 1 has a first position in which the key 3 is normally biased to a raised position by a suitable mechanical device. When the piano 1 is played the key 3 is switched from the first position to a second position by depressing the key 3. To practice the subject process, a key switch 10 is provided adjacent each of the piano keys 3. Each key 3 switch 10 may be an opto-interrupter saturated transistor switch, a suitable mechanical contact switch, or another suitable switch which can detect piano key movement from the first position to the second position without intefering with the piano action. For illustration purposes a second stage is illustrated to show how the keys 3 on the keyboard 2 are each detected, corresponding elements being indicated with prime numbers.

Each of the key switches 10 may be mounted on a suitable frame 12 out of sight inside the piano so as to follow piano keyboard 2 action as the keys 3 are depressed and released.

Each of the key switches 10 is in series with the power supply of a standard oscillator 14 which generates an AC signal on an oscillator output terminal 16 when the key switch is closed. Each of the oscillators 14 are selected to have a discrete frequency in the audio range. While various oscillators may be used, operational amplifier oscillators in a wein bridge configuration would be an example of a suitable oscillator. The oscillator output on the terminal 16 is a sine wave of maximum amplitude available without clipping. Each of the oscillators 14 have an identical amplitude and a unique frequency.

The second step in the subject process is generating an electric signal which is the algebraic sum of the AC signals generated by the oscillators 14. Persons versed in the art will appreciate that the oscillators 14 are signal generating devices of low power capability. Accordingly, to generate an electric signal which is the algebraic sum of the AC signals produced by the oscillators 14, each of the AC signals should first be passed through a buffer stage 18, such as an emitter follower which has a high input impedance and low output impedance. The buffered signal can then be passed through a passive voltage divider network 20 having suitable input impedances 22 and divider impedance 23 from each stage 18 so that each of the AC signals are algebraically combined.

As persons versed in the art will appreciate, an electric signal is thus generated which is the algebraic sum of the AC signals produced by each of the operational amplifiers 14. Obviously the electric signal which is so produced contains components of equal amplitudes but different frequencies. The next step in the subject process is therefore filtering the algebraic sum electric signal through a low pass filter 24 fed by the voltage divider 20 output 25. As persons versed in the art will appreciate, as the frequency is increased in the low pass filter 24 the amplitude is reduced. Therefore in the filtered signal exiting the low pass filter 24, the total energy component resulting from each of the various oscillator 14 frequencies is identical. Since amplitude and frequency are inversely proportional, the energy in the filtered signal at the frequency of the AC signals generated by each of the oscillators 14 is the same for each of the oscillators 14 having a corresponding key switch 10 in a closed position.

The last step in the process for recording electric signals corresponding to a unique operation sequence of a set of keys is therefore recording the filtered signal in a suitable recording medium, such as magnetic tape or magnetic wire. Since tape decks using magnetic tape in conventional cassettes are in common usage, the filtered signal from the low pass filter 24 could be preserved by recording it in a suitable tape deck 26.

Tape decks generally have from one to four channels for recording. A conventional piano has 88 keys. Persons versed in the art will appreciate that 88 oscillators 14 can easily be provided in a compact package. For example, each of the oscillators may be a 741 type operational amplifier integrated circuit. However, tape recorder capability generally is limited to approximately 15,000 Hertz (cycle per second). Accordingly, to facilitate recording electric signals corresponding to operation of 88 keys while maintaining adequate separation of signals, it is best to divide the keys into four 22 tone groups and record the signals from only 22 keys on each channel of the tape deck.

The process for reproducing mechanical action of a plurality of keys in addition to the above steps for recording electric signals corresponding to a unique operational sequence of a set of keys also includes the steps of playing back the filtered signal from tape deck 26 and filtering the playback signal through a high pass filter 28. The filtered signal is the algebraic sum of the AC signals recorded as aforementioned.

The next step in the reproduction process is detecting each of the AC signals in the filtered playback signal. As persons versed in the art will appreciate, such a detection stage 30 should have a high input impedance stage 32, which may be high input impedance operational amplifiers having their outputs connected to suitable decoders such as the 567 tone decoder integrated circuit 34 which are in common usage in push button telephone equipment. As persons versed in the art will appreciate a frequency sensitive decoder such as the 567 unit operates as a frequency sensitive switch.

When the frequency to which the decoder 34 is preset is not present in its input, the decoder output is an open circuit but when the frequency for which the decoder 34 is preset is present in its input its output becomes a closed circuit. Each of the decoders 34 is provided preset to the frequency generated by one of the oscillators 14. Accordingly, in a piano there would be 88 of the decoders 34.

As persons versed in the art will appreciate each of the decoders 34 are often termed a detector oscillator in reference to their frequency sensitivity.

The final step in the process for reproducing the mechanical action of a plurality of keys is energizing a suitable electromechanical device 36 which operates the key associated with an oscillator 14 having the same frequency as the frequency detected by the corresponding detector 34. The electromechanical device may include a relay coil which operates an electromagnet core in such a manner as to physically strike the mechanism associated with a key so as to cause movement of the piano key, as shown in the drawing by relay 36 operatively connected to the keys 3 as shown in dashed lines. In the alternative, persons versed in the art will appreciate that in a player piano a pneumatic mechanism exists in which a tracker bar is provided with an array of pneumatic holes which are permitted to communicate with the atmosphere in a predetermined manner controlled either by a paper tape having openings which alternately cover the holes or the holes may be controlled by individual control values. Accordingly, the electromechanical device 36 may be a solenoid operated control valve controlling the communication of a tracker bar hole with the atmosphere.

In summary, the process for reproducing mechanical action of a plurality of keys includes the process for recording electric signals corresponding to a unique operational sequence of a set of keys that each have first and second positions comprising the steps of generating a discrete frequency AC signal as each of the keys is switched from a first position to a second position, algebraically adding each of the AC signals, filtering the sum of the algebraic signal addition so as to generate a filtered signal in which the energy level of each of the AC signals equals the energy level of each of the other of the AC signals, and recording the filtered sum signal in a suitable recording medium. The process for reproducing mechanical action of a plurality of keys also includes a process for switching a plurality of keys in accordance with a recorded signal, which includes playing back the recorded signal, filtering the playback signal through a high pass filter so as to generate a filtered playback signal that is the algebraic sum of the AC signals, detecting each of the AC signals in the filtered playback signal, and energizing an electromechanical device so as to switch each of the keys from the first position to the second position in accordance with each of the AC signals detected on playback.

Persons versed in the art will appreciate that the subject process may be practiced by utilization of apparatus other than that described in the specification and drawings without departing from the spirit of this invention.

Figure 2:
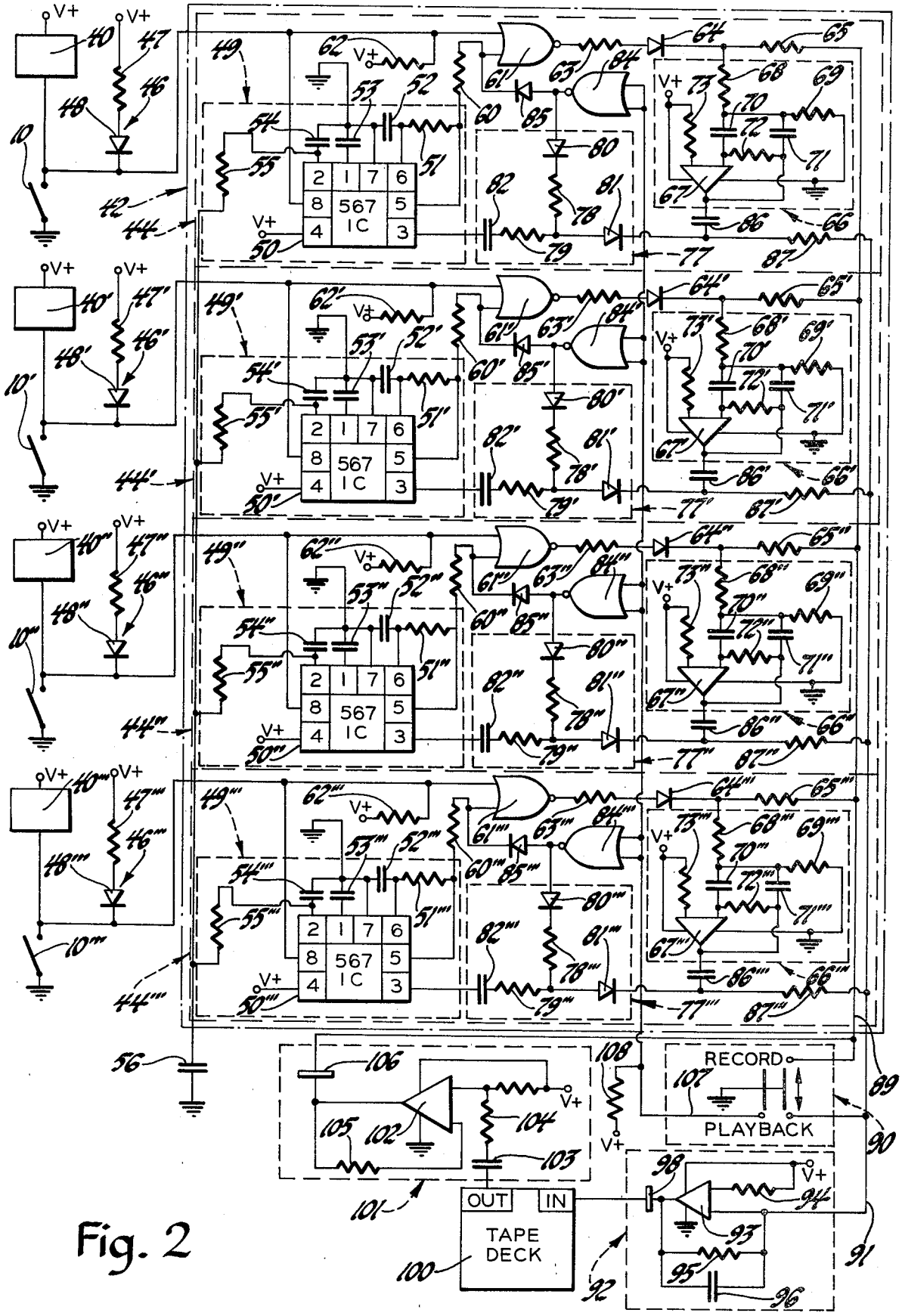
FIG. 2 is a schematic circuit diagram of apparatus according to the subject invention.

In FIG. 2 a schematic circuit diagram is illustrated showing specific apparatus which may be utilized to practice the subject invention.

In FIG. 2 the apparatus illustrated is responsive to four switches 10 through 10'''.

For purposes of discussion each of the switches 10 through 10''' in FIG. 2 may be assumed to be an electric switch associated with an electronic organ key. Each of the switches 10 through 10''' connects one of the electromechanical devices 40 through 40''' to ground when the corresponding switch is closed. When the switch is open a positive voltage illustrated as V+ is connected to the electromechanical devices 40 through 40''' but is unable to energize them.

A record and playback module 42 is illustrated in FIG. 2 having four stages 44 through 44'''. For reasons which will become apparent indicator circuits 46 through 46''' comprised of resistors 47 through 47''' and light emitting diodes 48 through 48''' which are connected to the V+ power supply in parallel with the electromechanical devices 40 through 40'''.

Since each of the stages 44 through 44''' are identical in configuration and differ only in value of certain circuit components corresponding numerals will be used in each stage.

Stage 44 includes in encoder-decoder stage 49. The primary unit in the encoder-decoder stage 49 is a model 567 integrated circuit 50 having eight terminals as illustrated in FIG. 2. Persons versed in the art will appreciate that the 567 integrated circuit 50 is in common usage in touch-tone telephone systems. Among the manufacturers of the 567 integrated circuit are Signetics Corporation, 811 East Arques Ave., Sunnyvale, Calif. 94086 and National SemiConductor Corporation, 2900 SemiConductor Drive, Santa Clara, Calif. 95051.

The 567 integrated circuit has a first function as a square wave oscillator which produces a continuous square wave output on its terminal 5. The 567 integrated circuit also produces an output signal on its terminal 8 in response to a signal applied to its terminal 3. The 567 integrated circuit is powered by a V+ supply in its terminal 4, which like the remainder of the apparatus illustrated in FIG. 2, functions from a five volt supply. With such a supply the 567 integrated circuit requires approximately a 35 millivolt RMS signal applied to its terminal 3. When such a signal is received the terminal 8 becomes grounded but in the absence of such a signal on terminal 3 the potential of terminal 8 is permitted to rise to approximately the supply voltage.

Associated with the 567 integrated circuit 50 are various tuning resistors and capacitors 51 through 56 which as persons versed in the art will appreciate control the square wave frequency generated on terminal 5 and the detection frequency to which the 567 integrated circuit responds when applied to its terminal 3.

The square wave output from terminal 5 of the 567 integrated circuit 50 is connected through a resistor 60 to one input on a NOR gate 61. The other input of the NOR gate 61 is connected to the switch 10, to the terminal 8 on the 567 integrated circuit, and to the supply voltage through a resistor 62.

The output of the NOR gate 61 is connected through a resistor 63 and diode 64 to a divider resistor 65.

The stage 44 also includes band pass double feedback filter 66 that includes a 3900 operational amplifier 67 having associated input, feedback, and adjustment resistors and capacitors 68 through 73.

The stage 44 also includes enable circuit 77 that includes resistors, diodes and a capacitor 78 through 82.

The stage 44 also includes another NOR gate 84 connected as an inverter, a diode 85, a capacitor 86, and a resistor 87.

The 3900 operational amplifier integrated circuits 67 may be obtainable from the manufacturers previously mentioned and also may be obtainable from Fairchild SemiConductor Components Group, Fairchild Camera and Instrument Corporation, 464 Ellis Street, Mountainview, Calif. 94042 and Motorola SemiConductor Products, Inc., Box 20912, Phoenix, Ariz. 85036. Several of these manufacturers also manufacture the 4001 integrated circuit units used as the NOR gates 61. For convenience in manufacturing the 4001 integrated circuit, it is conveniently provided in a single package containing 4 such units and the 3900 integrated circuit used as the operational amplifier 67 is conveniently manufactured in a package containing four such units.

Each of the stages 44' through 44''' contain elements similar to those previously described, which are numbered to correspond to the respective elements in the stage 44.

Each of the resistors 65 through 65''' are connected through a single lead 89 to a mode switch 90 having a first position illustrated in FIG. 2 for recording and a second position illustrated in FIG. 2 for playback.

Each of the resistors 87 through 87''' are connected through a lead 91 to a low pass filter 92 which includes a 3900 integrated circuit operational amplifier 93 and various tuning and adjusting elements 94 through 96 and coupling electrolytic capacitor 98 connected to the input terminal of the tape deck 100.

The output terminal of the tape deck 100 is connected to a high pass filter 101 that includes a 3900 integrated circuit operational amplifier 102 together with input and feedback elements 103 through 105 and has an output connected through an electrolytic capacitor 106 to the lead 89.

Switch 90 movement is as shown in FIG. 2. In record mode, switch 90 grounds lead 89 and the 4001 integrated circuits 84 through 84''' inputs are connected to V+ through a resistor 108. In playback mode, switch 90 grounds both the leads 91 and 107, grounding inputs of the 4001 integrated circuits 84 to 84''', which are connected as inverters.

The operation of the circuit in FIG. 2 will now be described with particular reference to the stage 44.

Assume switch 90 is in record mode. When a switch 10 is open the electromechanical device 40 is not actuated, the light emitting diode 48 is not illuminated, and both terminal 8 of the 567 integrated circuit 50 and one NOR gate 61 input are at the supply voltage. The other NOR gate 61 input is continuously supplied with a square wave through resistor 60 from terminal 5 of the 567 integrated circuit 50 but NOR gate 61 is kept turned off while switch 10 is open. The switch 90 in record position grounds lead 89 so resistors 63 and 65, together with nominal resistance of diode 64, operate as a voltage divider on band pass filter 66 input, but while NOR gate 61 is turned off band pass filter 66 input is at ground potential.

Assume the switch 10 is responsive to the key of an organ and that when the key is depressed the switch 10 closes so as to energize the electromechanical device 40 to produce a particular note from the organ. Closure of the switch 10 also grounds the light emitting diode 48, which is thus illuminated. It is contemplated by the subject invention that one of the light emitting diodes 48 would be placed adjacent each of the organ keys so that whenever an organ key is depressed a corresponding light emitting diode 48 is immediately energized.

When the switch 10 is closed it connects both the terminal 8 of the 567 integrated circuit 50 and the input terminal of the NOR gate 61 to ground. Grounding the NOR gate 61 input terminal permits the square wave received by the NOR gate 61 from the output terminal 5 of the 567 integrated circuit 50 to pass through the NOR gate 61. Since the lead 89 is grounded resistor 63 and 65, together with the forward biased diode 64, act as a voltage divider to apply the signal to the input resistor 68 of the bandpass filter 66.

It should be noted that the bandpass filter 66 is tuned to be responsive only to the frequency of the square wave signal generated by the 567 integrated circuit 50.

The band pass filter 67 shapes the signal which passes through it into a sine wave. The capacitor 86 prevents any DC signals coming out of the bandpass filter 66. Accordingly, the AC sine wave passes through resistor 87 and leads 91 to the low pass filter 92. The filtered signal from the low pass filter is recorded by the tape deck 100.

When switch 10 opens the voltage on the 567 integrated circuit 50 terminal 8 increases, turning off NOR gate 61 so as to immediately stop generating a sine wave in stage 44.

If both the switch 10 and the switch 10' are closed at the same time each of their respective stages 44 and 44' would generate a sine wave in the manner described above. The respective 567 integrated circuit 50 and 50' are adjusted to generate descrete frequencies which are unique. The other elements of the circuits 44 and 44' are selected to generate sine waves having predetermined amplitudes corresponding to the respective frequencies of the 567 integrated circuits 50 and 50' and their respective resistors 87 and 87' function as a voltage divider so the signal on the lead 91 applied to the low pass filter is the algebraic sum of the sine waves generated in the stages 44 and 44'. Persons versed in the art will appreciate that the amplitude of the sine waves generated by the stages 44 and 44' are equal. Accordingly, when the sine wave generated by the stages 44 and 44' are algebraically combined and pass through the low pass filter 92 the higher frequency is attenuated more than the lower frequency with the result that the output of the low pass filter 92 will include components from each of the stages 44 and 44' having equal energy levels.

It should be noted at this time that the recorded signal in the tape deck 100 has absolutely nothing whatsoever to do with the frequency of the musical note which is generated upon closing one of the switches 10 through 10'''. The frequencies of the signals recorded in the tape deck are only those signals which are generated in the various circuit oscillators in the stages 44 through 44'''. Indeed, switches 10 through 10''' could be responsive to a series of valves in a heating and cooling system or any one of many other types of systems other than responsive to operation of a musical instrument.

If it is assumed that the switches 10 through 10''' are closed in various sequences in accordance with the playing of a musical instrument it is apparent when the playing of the instrument is concluded a series of signals recorded on the tape deck 100 accurately correspond to the sequence and duration each of the switches 10 through 10''' was closed.

To reproduce the playing of the musical instrument the switch 90 is fixed in the playback position. The recorded signals are then played out of the tape deck 100 through the high pass filter 101 to produce a signal on the lead 89 which is the algebraic sum of the signals which had been recorded. The lead 89 applies this signal to each of the band pass filters 66 through 66'. However, since each of the band pass filters 66 through 66' is responsive only to a relatively narrow band width, they attenuate the signal they receive unless the signal they receive contains a component in the frequency range to which they are responsive. If the signal they receive does not include the frequency to which they are tuned the outputs of the band pass filters 66 through 66''' are so attenuated they can't be detected when applied to a 567 integrated circuit terminal 3.

However, if the signal received by the band pass filter 66 includes a signal of the frequency to which it is responsive the signal is not attenuated but rather passes through enable circuit 77 to the input terminal 3 of the 567 integrated circuit 50 in a sufficient amplitude to be detected by the 567 integrated circuit 50. When this detection takes place the voltage on terminal 8 of the 567 integrated circuit 50 drops to ground. Therefore even though the switch 10 is opened the electromechanical device 40 is actuated as if switch 10 were closed and the musical instrument sounds the appropriate musical note. At the same time the light emitting diode 48 is connected to ground as if the switch 10 were closed so as to light the light emitting diode 48 and indicate which note had been previously played.

In playback lead 107 grounds all NOR 84 through 84''' inputs so their outputs go to high voltage to keep NOR gates 61 through 61''' outputs at low voltage, which keeps enable circuit 77 through 77''' forward biased so as to permit passage of the signal to terminal 3 of the 567 integrated circuits 50 through 50'''.

Even though the output terminal 8 of the 567 integrated circuit 50 assumes ground potential when the predetermined frequency is detected the NOR gate 61 is rendered inoperable because the NOR gate 84 has both of its inputs connected to ground through the mode switch 90.

Persons versed in the art will appreciate that the subject apparatus may be used in combination with a piano or other instrument that does not generate a note simply by electrically grounding an electromechanical device 40. For a piano the switches 10 through 10''' could simply detect key movement.

In a piano merely illuminating the light emitting diodes 48 through 48''' on playback would be a valuable teaching tool to a student by showing which note sequence should be sounded as the student learns to play the piano. It is thus apparent that a library of prerecorded tapes may be used to illuminate the light emitting diodes in a certain sequence that teach a student how to play a particular song.

Of course, if it is desired to actually operate piano keys rather than merely indicate their sequence of prior operation, electromechanical devices 40 through 40''' may be relays that can be energized and mechanically connected to a piano key type device as shown in FIG. 1 to actually move the piano keys rather than simply indicate key operation by energizing light emitting diodes 48 through 48'''.

It is thus apparent that the subject apparatus provides a highly accurate method for recording and reproducing electric signals corresponding to key operation and for reproducing key operation of a piano or other musical instrument or for indicating a sequence of key operation.

Even though most organs utilize an electromechanical device similar to that illustrated by the number 40 in the drawings connected to a switch 10 which is connected to ground, some organs are known to have the switch 10 connected to a positive voltage instead of to ground. Persons versed in the art will appreciate that in devices of this nature a slight change in the logic circuitry employed can be made without departing from the spirit of this invention. For example, under circumstances where the switch 10 is connected to a positive voltage and the electromechanical device 40 and light emitting diode 48 are reversed in their operation by connecting them to ground the NOR gate 61 can be replaced by a NAND gate and an inverter inserted in the lead from the output terminal 8 of the 567 integral circuit 50 would compensate for this polarity change in the signal received from the closure of the switch 10.

As is apparent from the above discussion and description, the apparatus of FIG. 2 employs a unique circuit arrangement in which the 567 integrated circuit 50 is coupled through the NOR gate 61 to band pass filter 66 to generate a sine wave when the selectively operable mode switch 90 is in the first position for recording. While in the first position the switch 90 permits the V+ applied through resistor 108 and NOR gate 84 to keep the enable circuit 77 reverse biased to prevent the 567 integrated circuit 50, which operates as a frequency responsive switch, from being coupled to the output of the band pass filter 66.

When the selectively operable mode switch 90 is placed in the second position the lead 89 is no longer grounded through the switch 90 so the reprocessed signal from the high pass filter 101 is connected to the band pass filter 66. At the same time the switch 90 is coupled through the NOR gate 84 to forward bias the enable circuit 77 and thus selectively couple the output of the band pass filter 66 to the 567 integrated circuit 50. Thus on playback the band pass filter 66 detects the presence of a predetermined frequency AC signal in the reprocessed signal from the high pass filter 101 and applies this detected frequency through the enable circuit 77 to the 567 integrated circuit 50.

The 567 integrated circuit 50 and the band pass filter 66 are each tuned to be responsive to a particular frequency. When an AC signal of that particular frequency is detected in the reprocessed signal supplied by the high pass filter 101 terminal 8 of the 567 integrated circuit goes to ground, causing energization of the electromechanical device 40 and light emitting diode 48. The 567 integrated circuit 50 thus continuously generates a first signal on terminal 8 except when an AC signal of the predetermined frequency is detected on terminal 3, at which time the 567 integrated circuit 50 generates a second signal on the terminal 8 by grounding it.

It is thus apparent that the apparatus of FIG. 2 both employs the band pass filter 66 as a wave form shaper to shape the square wave received through NOR gate 61 when recording signals and on playback the band pass filter 66 facilitates detection of a predetermined frequency. When used in detecting a particular frequency the band pass filter 66 also provides the function of a filter to reduce any noise effects in the reprocessed signal from the high pass filter 101 and tape deck 100.

By using a double pole double throw switch for the mode switch 90 the effect of noise signals in the power supply employed by the apparatus is greatly reduced.

Persons versed in the art will appreciate that various tuning techniques may be employed for the tuning of the 567 integrated circuit 50, the band pass filter 66, the low pass filter 92, and the high pass filter 101. Each of these various components have been illustrated in FIG. 2 with various tuning elements associated therewith as one embodiment of the subject invention. Various values of these tuning components may be used and additional or fewer of these tuning components may be employed by persons versed in the art to practice the subject invention without departing from the spirit of the invention.

What is claimed is:

1. A process for recording electric signals corresponding to a unique operation sequence of a set of keys that each have first and second positions comprising, in combination, the steps of generating a discrete frequency AC signal as each of said keys is switched from said first position to said second position; algebraically adding said AC signals; filtering the sum of said algebraic addition through a low pass filter so as to generate a filtered signal in which the energy level components of each AC signal are equal; and recording said filtered signal in a recording medium.

2. The process of claim 1 in which said AC signals corresponding to key movement signals are sine waves of substantially identical amplitudes.

3. The process of claim 1 in which said recording medium is a magnetic tape.

4. The process of claim 1 in which said AC signals corresponding to key movement signals are sine waves of substantially identical amplitudes and said recording medium is a magnetic tape.

5. A process for reproducing mechanical action of a plurality of keys which each have first and second positions comprising, in combination, the steps of generating a plurality of AC signals which are each of a unique frequency and which each correspond to movement of a key from said first position to said second position; generating an algebraic sum signal which is the algebraic sum of said AC signals; filtering said algebraic sum signal through a low pass filter so as to generate a filtered signal in which the energy levels of each AC signal components are equal; recording said filtered signal; generating a playback signal by playing back said filtered signal; filtering said playback signal through a high pass filter so as to generate a filtered playback signal that is the algebraic sum of said AC signals; detecting each of said AC signals in said filtered playback signal; and energizing an electromechanical device so as to switch each of said keys corresponding to each of said detected AC signals from said first position to said second position.

6. Apparatus for recording a signal corresponding to the operational sequence of a plurality of keys that each have first and second positions comprising, in combination, a signal generator operatively connected to each of said keys, each of said signal generators being responsive to a key so as to generate a discrete frequency AC signal when the key to which the signal generator is responsive is in said second position and to not generate a signal when the key to which the signal generator is responsive is in said first position, each of said AC signals having substantially the same amplitude; signal combining apparatus for algebraically adding said AC signals so as to generate a combined signal equal to the algebraic sum of said AC signals; a low pass filter responsive to said algebraic sum for generating a filtered signal in which the energy level components of each of said AC signals are equal; and a recorder responsive to said filtered signal for recording said filtered signal.

7. Apparatus for indicating operational sequence of a set of keys from a prerecorded signal in which operation of each of said keys between a first position and a second position is represented by an AC signal having a predetermined energy level and a unique frequency, the energy levels of said AC signals being substantially equal, comprising, in combination, a high pass filter responsive to said prerecorded signal for generating a filtered signal that is the algebraic sum of each and energy AC signal component in said prerecorded signal; a plurality of frequency responsive detectors that are each responsive to one of said AC signal frequencies, said filter being connected to each of said detectors so as to enable each of said detectors to monitor said filtered signal; and a plurality of indicators that are each responsive to one of said detectors for indicating when one of said AC signals is detected by one of said detectors whereby operation of said keys between said first position and said second position is indicated.

8. Apparatus for indicating operational sequence of a plurality of keys that are each switchable between a first position and a second position comprising, in combination, a plurality of signal generating networks that are each responsive to a key and generate AC signals of substantially equal amplitudes and discrete frequencies, each of said networks generating said AC signal when one of said keys is in said second position and not generating a signal when said one key is in said first position; an addition network for algebraically adding said AC signals; a first filter network for filtering said algebraic signal sum so as to generate a filtered signal in which each of said AC signals that are present are of uniform energy level; a recorder connected to said filter for recording said filtered signal; a second filter responsive to said recorded signal for generating a signal which is the algebraic sum of each recorded AC signal filtered by said second filter; a plurality of frequency detectors that are each connected to said second filter so as to receive said second filter algebraic sum signal and are each responsive to one of said AC signal frequencies for detecting the presence of said AC signal components in said recorded signal; and a plurality of indicators that each respond to one of said frequency detectors so as to indicate detection of said AC signal components in said recorded signal whereby operational sequence of said keys is indicated showing each of said keys being switched between said first position and said second position.

9. Apparatus for duplicating a predetermined energization sequence of a plurality of electrical devices comprising, in combination, a plurality of AC signal generators which are each responsive to energization of one of said electrical devices and which each generate a unique frequency AC signal when one of said electrical devices is energized; an addition network for generating a combined signal which is the algebraic sum of said AC signals; a first filter network responsive to said combined signal for generating a filtered signal that includes components at each frequency of said generated AC signals, each of said components having substantially the same energy level; a recorder for recording and reproducing said filtered signal; a second filter responsive to said reproduced filtered signal for generating a second filtered signal which is the algebraic sum of said AC signals; a plurality of decoders that are each responsive to said second filtered signal so as to detect the presence of one of said AC signals in said second filtered signal and energize one of said electrical devices, whereby the predetermined energization sequence of said electrical devices is duplicated.

10. Apparatus for indication and duplication of operational sequence of multiple keys wherein each key generates a signal having a first condition and a second condition comprising, in combination, a record circuit responsive to said keys for generating a signal indicative of which of said keys are in said first condition and which of said keys are in said second condition; a recorder for recording said signal; and a playback circuit responsive to said recorded signal for duplicating the signals generated by each of said keys; said record circuit including an array of AC signal generators that are each responsive to at least one of said key signals and generate an AC signal of a predetermined unique frequency, an addition network that algebraically adds said AC signals so as to generate a combined signal that is substantially proportional to the algebraic sum of said AC signals, and a low pass filter that is responsive to said combined signal for generating a filtered signal that includes frequency components at the frequency of each of said AC signals with each of said frequency components having substantially the same energy levels, said filtered signal being said recorded signal; said playback circuit including a high pass filter that is responsive to said recorded signal for generating a signal which is substantially the algebraic sum of said AC signals and a detection circuit responsive to said high pass filter generated signal for detecting each of said AC signals and for duplicating the signals generated by each of said keys.

11. Apparatus for indicating operation of a set of keys having a first condition and a second condition comprising, in combination, an array of square wave generators that each have a unique frequency and are each associated with one of said keys; an array of band pass filters; an array of gates that are each responsive to one of said keys for selectively coupling one of said square wave generators to one of said band pass filters so that when a key is in said first condition one of said gates prevents coupling one of said square wave generators to one of said band pass filters and when a key is in said second condition one of said gates couples one of said square wave generators to one of said band pass filters so that said band pass filter shapes the square wave received by said band pass filter substantially into a sine wave AC signal at the frequency of said square wave; an addition network responsive to said sine waves for algebraically adding said sine waves so as to generate a combined signal that is the algebraic sum of said sine waves; a low pass filter which processes said combined signal so as to generate a processed signal in which the energy level at the frequencies of each AC signal present in said combined signal are substantially equal; a recorder for recording said processed signal and reproducing said processed signal; a high pass filter for reprocessing said recorded signal so as to generate a reprocessed signal which is the algebraic sum of said AC signals; a selectively operable switch having first and second positions coupled to said array of gates for selectively preventing the coupling of said array of square wave generators to said array of band pass filters and connected to said array of band pass filters for selectively coupling said reprocessed signal to said array of band pass filters so that when said selectively operable switch is in said first position said array of square wave generators may be coupled to said array of band pass filters by said gates and when said selectively operable switch is in said second position said gates are prevented from coupling said array of square wave generators to said array of band pass filters and said reprocessed signal is coupled to said array of band pass filters so that each of said band pass filters my detect the presence of a predetermined AC signal in said reprocessed signal; an array of frequency responsive switches which each generate a first signal in response to an input signal which is not of a predetermined frequency and which each generate a second signal in response to an input signal which is of a predetermined frequency; an array of enable circuits coupled to said selectively operable switch so that each of said enable circuits selectively couples one of said band pass filters to one of said frequency responsive switches so that when said selectively operable switch is in said first position each of said enable circuits prevents coupling one of said band pass filters to one of said frequency responsive switches so as to keep said frequency responsive switch generating said first signal and when said selectively operable switch is in said second position each of said enable circuits couples one of said band pass filters to one of said frequency responsive switches so as to enable each of said frequency responsive switches to generate said second signal when an AC signal of the frequency to which said frequency responsive switch is responsive is coupled to said frequency responsive switch from one of said band pass filters; and an array of indicators that are each responsive to said signals generated by one of said frequency responsive switches for indicating the operational sequence of said set of keys.

* * * * *